US012571076B2

(12) United States Patent
Su et al.

(10) Patent No.: US 12,571,076 B2
(45) Date of Patent: Mar. 10, 2026

(54) ALUMINUM MATERIAL, PREPARATION METHOD THEREOF, AND BOWL-SHAPED ALUMINUM BLOCK

(71) Applicant: HANGZHOU CPMC CO. LTD., Zhejiang (CN)

(72) Inventors: Qiwei Su, Zhejiang (CN); Xiaohui Hong, Zhejiang (CN); Zhenya Tan, Zhejiang (CN)

(73) Assignee: HANGZHOU CPMC Co. Ltd., Zhejiang (CN)

( * ) Notice: Subject to any disclaimer, the term of this patent is extended or adjusted under 35 U.S.C. 154(b) by 981 days.

(21) Appl. No.: 17/637,123

(22) PCT Filed: Jul. 12, 2021

(86) PCT No.: PCT/CN2021/105709
§ 371 (c)(1),
(2) Date: Feb. 22, 2022

(87) PCT Pub. No.: WO2022/105264
PCT Pub. Date: May 27, 2022

(65) Prior Publication Data

US 2022/0356548 A1 Nov. 10, 2022

(30) Foreign Application Priority Data

Nov. 17, 2020 (CN) ..... 202011288660.6

(51) Int. Cl.
*C22C 21/00* (2006.01)
*C22C 1/02* (2006.01)
*C22F 1/04* (2006.01)

(52) U.S. Cl.
CPC ..... *C22C 21/00* (2013.01); *C22C 1/026* (2013.01); *C22F 1/04* (2013.01)

(58) Field of Classification Search
None
See application file for complete search history.

(56) References Cited

U.S. PATENT DOCUMENTS

2015/0159243 A1* 6/2015 Shzuki ..... C22C 21/00 420/548

FOREIGN PATENT DOCUMENTS

CN 102392202 A 3/2012
CN 102912190 A 2/2013
(Continued)

OTHER PUBLICATIONS

Aluminum Association, International Alloy Designations and Chemical Composition Limits for Wrought Aluminm and Wrought Aluminum Alloys, Teal sheets, pp. 1-28. (Year: 2006).*
(Continued)

*Primary Examiner* — Keith D. Hendricks
*Assistant Examiner* — Janell C Morillo
(74) *Attorney, Agent, or Firm* — Manelli Selter PLLC; Edward Stemberger

(57) ABSTRACT

An aluminum material, a preparation method thereof, and a bowl-shaped aluminum block are provided in the present disclosure, which relates to the technical field of alloys. Controlling the amount of manganese to 0.03-0.5 wt % in the present disclosure can improve the structure and enhance the impact mechanical properties of aluminum material; nickel can improve the strength and rust resistance of aluminum material, strontium can form an aluminum-strontium combination to adjust the crystal orientation of the metal lattice, which can improve molding and greatly enhance flexibility, and zirconium has a synergistic effect, which can improve the corrosion resistance of aluminum material, and improve surface gloss. The aluminum material provided by the present disclosure has a hardness of 23-30
(Continued)

HB, a tensile strength of 70-100 MPa, a yield strength of 35-59 MPa, and an elongation at break of 40-60%.

15 Claims, 2 Drawing Sheets

(56) References Cited

FOREIGN PATENT DOCUMENTS

| | | | | | |
|---|---|---|---|---|---|
| CN | 105715003 | A | | 6/2016 | |
| CN | 111607722 | A | * | 9/2020 | ..... B21B 1/22 |
| CN | 112410621 | A | | 2/2021 | |
| JP | 2007131917 | A | | 5/2007 | |

OTHER PUBLICATIONS

Davis, J.R. "Aluminum and Aluminum Alloys", ASM International, p. 41, 45, 639. (Year: 1993).*
International Search Report in PCT/CN2021/105709 dated Sep. 29, 2021.

* cited by examiner

ALUMINUM MATERIAL, PREPARATION METHOD THEREOF, AND BOWL-SHAPED ALUMINUM BLOCK

CROSS REFERENCE TO RELATED APPLICATION

This patent application claims the benefit and priority of Chinese Patent Application No. 202011288660.6 filed on Nov. 17, 2020, the disclosure of which is incorporated by reference herein in its entirety as part of the present application.

TECHNICAL FIELD

The present disclosure relates to the technical field of alloys, in particular to an aluminum material, a preparation method thereof, and a bowl-shaped aluminum block.

BACKGROUND ART

In the prior art, aluminum products are made of commercial pure aluminum, which has good processing performance but relatively weak strength. It is necessary to carry out research on hard aluminum materials, especially for large-size products, to achieve the purpose of promoting the performance improvement of the aluminum materials by improving material strength, strengthening the shape, and controlling the consistency of the material and other methods.

The hardness of the commonly used 1070A aluminum material is only 18.5 HB, the tensile strength is 70 MPa, and the yield strength is 34 MPa, which has the problem of insufficient strength.

SUMMARY

In view of this, the purpose of the present disclosure is to provide an aluminum material, a preparation method thereof, and a bowl-shaped aluminum block. The aluminum material provided by the present disclosure has high strength and strong processing performance.

In order to achieve the above purpose, the present disclosure provides the following technical schemes:

The present disclosure provides an aluminum material, wherein comprising the following elements by mass percentage: 0.1-0.2% of Si, 0.25-0.35% of Fe, 0-0.05% of Cu, 0.03-0.5% of Mn, 0-0.03% of Mg, 0-0.05% of Zn, 0-0.05% of Ti, 0-0.03% of Ni, 0-0.05% of Sr, 0-0.05% of Zr, 0-0.05% of B, the balance of Al, a mass percentage of Al is more than or equal to 99.2%, and the mass percentages of Cu, Mg, Zn, Ti, Ni, Sr, Zr and B are not zero.

In some embodiments, the aluminum material comprises 0.15-0.18 wt % of Si.

In some embodiments, the aluminum material comprises 0.28-0.32 wt % of Fe.

In some embodiments, the aluminum material comprises 0.01-0.03 wt % of Cu.

In some embodiments, the aluminum material comprises 0.1-0.3 wt % of Mn.

In some embodiments, the aluminum material comprises 0.1-0.02 wt % of Mg.

In some embodiments, the aluminum material comprises 0.01-0.03 wt % of Zn.

In some embodiments, the aluminum material comprises 0.01-0.03 wt % of Ti.

In some embodiments, the aluminum material comprises 0.01-0.02 wt % of Ni.

In some embodiments, the aluminum material comprises 0.01-0.03 wt % of Sr.

In some embodiments, the aluminum material comprises 0.01-0.03 wt % of Zr.

In some embodiments, the aluminum material comprises the following elements by mass percentage: 0.1% of Si, 0.25% of Fe, 0.01% of Cu, 0.3% of Mn, 0.03% of Mg, 0.02% of Zn, 0.02% of Ti, 0.03% of Ni, 0.01% of Sr, 0.01% of Zr, 0.01% of B and the balance of Al.

In some embodiments, the aluminum material comprises the following elements by mass percentage: 0.1% of Si, 0.35% of Fe, 0.05% of Cu, 0.03% of Mn, 0.03% of Mg, 0.05% of Zn, 0.05% of Ti, 0.03% of Ni, 0.05% of Sr, 0.05% of Zr, 0.05% of B and the balance of Al.

In some embodiments, the aluminum material has a hardness of 23-30 HB, a tensile strength of 70-100 MPa, a yield strength of 35-59 MPa, and an elongation at break of 40-60%.

The present disclosure also provides a method for preparing the aluminum material described in above technical schemes, wherein comprising the following steps:

Batching according to the elements, and then smelting to obtain a molten aluminum;

Subjecting the molten aluminum to a first slagging-off, refining, a second slagging-off, refining and degassing, and roll casting in sequence to obtain an aluminum coil blank;

Subjecting the aluminum coil blank to a first hot-rolling, cooling, a second cold-rolling and punching in sequence to obtain an aluminum block blank;

Subjecting the aluminum block blank to annealing and a first aging treatment in sequence to obtain a first aging product;

Subjecting the first aging product to a surface treatment and a second aging treatment to obtain the aluminum material.

In some embodiments, the second slagging-off uses a TI-B refiner, the TI-B refiner includes TiB particles and a rare earth refiner, and the amount of the TI-B refiner is 0.08 wt % of the molten aluminum.

In some embodiments, the amount of the TiB particles is 0.05-0.07 wt % of the molten aluminum, and the amount of the rare earth refiner is 0.01-0.03 wt % of the molten aluminum.

In some embodiments, the thickness of the blank after the first hot-rolling is reduced by 30-80%, and the thickness of the blank after the second cold-rolling is reduced by 20-60%.

In some embodiments, the cooling is cooling at 500° C. for 0.5 h-2 h and then cooling at 300° C. for 0.5 h-2 h.

In some embodiments, the temperature of the annealing and the first aging treatment is independently 300-500° C., and the time is 2-20 h.

In some embodiments, the surface treatment is a process of granulating the surface of the aluminum alloy.

In some embodiments, the process of granulating the surface of the aluminum alloy comprises the following steps: passing the first aging product through a tunnel with a dense spraying to obtain a dense annular gravure aluminum block with a uniform corrugated surface, the tunnel is sprayed with aluminum alloy particles with high surface strength, the particle size of the aluminum alloy particles is 0.3-1 mm, the air pressure of the dense spray is 2-10 bar, and the density of the dense spray is 10-20 lattice/mm$^2$.

In some embodiments, the temperature of the second aging treatment is 80-200° C., and the time is 0.5-2 h.

In some embodiments, after the second aging treatment, it further comprises mixing the second aging product, a polyol and a fatty acid surface treatment agent, then performing surface additive treatment to obtain a transition layer, and then removing the transition layer to obtain the aluminum material.

In some embodiments, the fatty acid surface treatment agent is sodium stearate, stearamide or N, N'-ethylene hisstearamide.

In some embodiments, the mass ratio of the second aging product, polyol and fatty acid surface treatment agent is 300-400:0.3-1.0:0.03-0.5.

The present also provides a bowl-shaped aluminum block, wherein the material is the aluminum material described in above technical schemes or the aluminum material prepared by the method described in above technical schemes.

In some embodiments, the outer diameter of the bowl-shaped aluminum block is 34-80 mm, the depth is 0.5-2 mm, the diameter of the inner concave surface is 10-66 mm, and the angle of the inner concave surface to the horizontal plane is 1-12°.

The present disclosure provides an aluminum material, wherein comprising the following elements by mass percentage: 0.1-0.2% of Si, 0.25-0.35% of Fe, 0-0.05% of Cu, 0.03-0.5% of Mn, 0-0.03% of Mg, 0-0.05% of Zn, 0-0.05% of Ti, 0-0.03% of Ni, 0-0.05% of Sr, 0-0.05% of Zr, 0-0.05% of B, the balance of Al, the mass percentage of Al is more than or equal to 99.2%, and the mass percentages of Cu, Mg, Zn, Ti, Ni, Sr, Zr and B are not zero. Controlling the content of manganese to 0.03-0.5 wt % in the present disclosure can improve the structure and enhance the impact mechanical properties of aluminum material; nickel can improve the strength and rust resistance of aluminum material, strontium can form an aluminum-strontium combination to adjust the crystal orientation of the metal lattice, which can improve molding and greatly enhance flexibility, and zirconium has a synergistic effect, which can improve the corrosion resistance of aluminum material, and improve surface gloss. The aluminum material provided by the present disclosure has a hardness of 23-30 HB, a tensile strength of 70-100 MPa, a yield strength of 35-59 MPa, and an elongation at break of 40-60%. The aluminum material provided by the present disclosure has no oil stains, dust, pores, slag inclusions, no pull marks on the surface, no surface tearing, no sharp burrs and pits exceeding 0.2 mm, and no obvious grain direction on the surface.

The present disclosure also provides a method for preparing the aluminum material described in above technical schemes, wherein comprising the following steps: batching according to the elements described in above technical schemes, and then smelting to obtain a molten aluminum; subjecting the molten aluminum to a first slagging-off, refining, a second slagging-off, refining and degassing, and roll casting in sequence to obtain an aluminum coil blank; subjecting the aluminum coil blank to a first hot-rolling, cooling, a second cold-rolling and punching in sequence to obtain an aluminum block blank; subjecting the aluminum block blank to annealing and a first aging treatment in sequence to obtain a first aging product; subjecting the first aging product to a surface treatment and a second aging treatment to obtain the aluminum material. In the present disclosure, most impurities (large particles of foreign matter contained in the aluminum alloy, mainly including non-metallic and iron-based infusible matter) and oxides can be removed by the first slagging-off. Refining can refine the crystal grains, and the second slagging-off can completely remove impurities (including small particles generated during the melting of aluminum alloy and high melting point waste) and oxides. Refining and degassing can improve the quality of the melt and facilitate the production of qualified cast-rolled materials. Annealing and the first aging treatment can disperse the stress, make the anisotropic stress uniform, and provide good metal material fluidity for subsequent molding of aluminum block, and the surface treatment and the second aging treatment can reduce the difference in the internal structure of aluminum materials at different times.

DETAILED DESCRIPTION OF THE EMBODIMENTS

Figure 1:
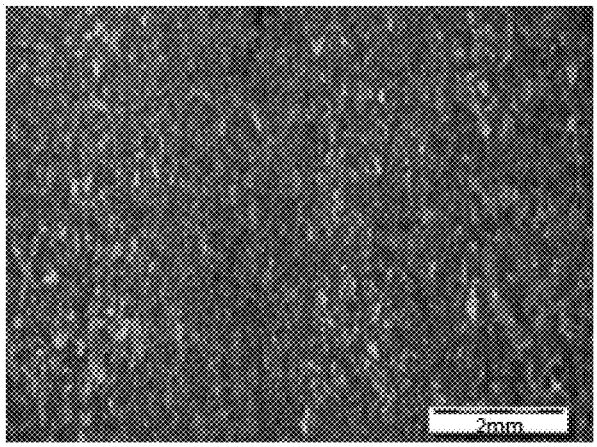
FIG. 1 is a microscopic morphology diagram of the aluminum material prepared in Example 1.

The present disclosure provides an aluminum material, wherein comprising the following elements by mass percentage: 0.1-0.2% of Si, 0.25-0.35% of Fe, 0-0.05% of Cu, 0.03-0.5% of Mn, 0-0.03% of Mg, 0-0.05% of Zn, 0-0.05% of Ti, 0-0.03% of Ni, 0-0.05% of Sr, 0-0.05% of Zr, 0-0.05% of B, the balance of Al, a mass percentage of Al is more than or equal to 99.2%, and the mass percentages of Cu, Mg, Zn, Ti, Ni, Sr, Zr and B are not zero.

The aluminum material of the present disclosure preferably comprises 0.15-0.18 wt % of Si, which can enhance the strength of the aluminum material.

The aluminum material of the present disclosure preferably comprises 0.28-0.32 wt % of Fe, which can enhance the strength of the aluminum material.

The aluminum material of the present disclosure preferably comprises 0.01-0.03 wt % of Cu, which can enhance the strength of the aluminum material.

The aluminum material of the present disclosure preferably comprises 0.1-0.3 wt % of Mn, which can improve the structure and enhance the impact mechanical properties of the aluminum material.

The aluminum material of the present disclosure preferably comprises 0.1-0.02 wt % of Mg, which can enhance the rust resistance of the aluminum material and improve the surface processing fluidity.

The aluminum material of the present disclosure preferably comprises 0.01-0.03 wt % of Zn, which can adjust the crystal grain structure and promote the optimization of the aluminum material.

The aluminum material of the present disclosure preferably comprises 0.01-0.03 wt % of Ti, which can be used as a regulator to adjust the internal crystal phase structure of the aluminum material and refine the crystal grains.

The aluminum material of the present disclosure preferably comprises 0.01-0.02 wt % of Ni, which can improve the strength and rust resistance of the aluminum material.

The aluminum material of the present disclosure preferably comprises 0.01-0.03 wt % of Sr, which can form an aluminum-strontium combination, adjust the crystal orientation of the metal lattice, improve molding, and greatly enhance flexibility.

The aluminum material of the present disclosure preferably comprises 0.01-0.03 wt % of Zr, the zirconium element and the strontium element can act synergistically to improve the corrosion resistance of the aluminum material and improve the surface gloss.

In the present disclosure, the aluminum material preferably has a hardness of 23-30 HB, a tensile strength of 70-100 MPa, a yield strength of 35-59 MPa, and an elongation at break of 40-60%.

The present disclosure also provides a method for preparing the aluminum material described in above technical schemes, wherein comprising the following steps:

Batching according to the elements described in above technical schemes, and then smelting to obtain a molten aluminum;

Subjecting the molten aluminum to a first slagging-off, refining, a second slagging-off, refining and degassing, and roll casting in sequence to obtain an aluminum coil blank;

Subjecting the aluminum coil blank to a first hot-rolling, cooling, a second cold-rolling and punching in sequence to obtain an aluminum block blank;

Subjecting the aluminum block blank to annealing and a first aging treatment in sequence to obtain a first aging product;

Subjecting the first aging product to a surface treatment and a second aging treatment to obtain the aluminum material.

In the present disclosure, unless otherwise specified, the raw materials used are all conventional commercial products in the field.

In the present disclosure, the element described in the above technical scheme is batched and then smelted to obtain a molten aluminum.

In the present disclosure, the batching process is preferably as follows: a 1090 standard aluminum ingot and a 3003 recycled aluminum material are mixed, evenly split and mixed, and then hoisted into the blast furnace in units of 3-10 T. The materials are dispersed, the furnace is started to reach 600-900° C. for smelting, the molten state is maintained for 0.5-1 h, then the molten material is disturbed and stirred by a high-pressure gas column at 2-20 rpm for 15-45 min, and then Fe agent, Si agent, Cu agent, Mn agent, Mg agent, Zn agent, Ti agent, Ni agent, Zr agent and Sr agent are added. In the present disclosure, the gas of the high-pressure gas column is preferably an inert gas, and the pressure is preferably 2-8 bar. The use of 3003 recycled aluminum materials in the present disclosure can realize resource reuse, improve environmental performance, and achieve the effect of reducing costs. In the present disclosure, the amount of 3003 recycled aluminum materials preferably accounts for 10 wt % of the feed.

After the molten aluminum is obtained, the present disclosure sequentially performs a first slagging-off, refining, a second slagging-off, refining and degassing, and roll-casting on the molten aluminum to obtain an aluminum coil blank.

In the present disclosure, the first slagging-off preferably uses an air column to agitate the molten aluminum.

In the present disclosure, after the completion of the first slagging-off, it is preferable to further include sampling analysis and a second adjustment. The second adjustment is to add an alloying agent to adjust the content of each element in the alloy to be consistent with the above technical scheme.

In the present disclosure, the second slagging-off uses a TI-B refiner, the TI-B refiner includes TiB particles and a rare earth refiner, and the amount of the TI-B refiner is 0.08 wt % of the molten aluminum, wherein the amount of TI-B refining agent is preferably 0.05-0.07 wt %, and the amount of rare earth refining agent is preferably 0.01-0.03 wt %. The present disclosure uses TI-B particles and rare earth refiner together as a grain refiner, and by first refining and stabilizing, and then adding an alloy-strengthening alloy, it does not affect the effect of grain refinement and does not conflict with other alloying elements.

In the present disclosure, the TI-B refiner is preferably kept at a constant temperature for 0.5 h-1 h after being added.

In the present disclosure, the refining and degassing process is preferably to perform online purification, degassing and slagging-off in a degassing device to remove stress, improve melt quality, and facilitate the production of qualified roll-casted materials.

In the present disclosure, after the refining and degassing, it is preferable to further include using a second filtration device for impurity removal and filtration.

In the present disclosure, the roll-casting is preferably carried out on a rotary belt casting machine, after the refining and degassing or impurity removal and filtering, the aluminum liquid is roll-casted into aluminum coil blanks by continuously rotating casting rolls. The present disclosure has no special limitation on the rotating belt casting machine, and a rotating belt casting machine composed of a casting wheel and a steel belt, which is well known in the prior art, can be used.

After the aluminum coil blank is obtained, the present disclosure sequentially performs a first hot-rolling, cooling, a second cold-rolling and punching on the aluminum coil blank to obtain an aluminum block blank.

In the present disclosure, the thickness of the blank after the first hot-rolling is preferably reduced by 30-80%, and the thickness of the blank after the second cold-rolling is preferably reduced by 20-60%. In the embodiment of the present disclosure, the reduction in thickness each time is preferably 3-15 mm.

In the present disclosure, the cooling is preferably cooling at 500° C. for 0.5 h-2 h and then cooling at 300° C. for 0.5 h-2 h.

In the present disclosure, the width of the cold-rolled material obtained by the second cold-rolling is preferably 0.3-1.5 m.

In the present disclosure, the punching preferably uses a punching machine with a tonnage of 100 tons and above to punch out aluminum blocks.

In the present disclosure, the oil is preferably used to protect the punching surface of the aluminum block during the punching process, and the oil is preferably MOBIL SHC CIBUS 68, which is sprayed with 5-10 g/50-100 work pieces each time. In the present disclosure, the cold-rolled material directly enters the subsequent punching process, which has the advantage of avoiding the splitting process, high efficiency and low consumption.

After the aluminum block blank is obtained, the present disclosure sequentially performs annealing and first aging treatment on the aluminum block blank to obtain the first aged product.

In the present disclosure, the temperature of the annealing and the first aging treatment is independently preferably 300-500° C., more preferably 400-500° C., and the time is independently preferably 2-20 h, more preferably 10-15 h.

After the first aging treatment is completed, the present disclosure preferably naturally cools and stores the first aging product for 2-8 h.

In the present disclosure, it is preferable to keep the top space of the furnace full of inert gas during the annealing process to prevent the problem of excessive oxidation. During the annealing process, the aluminum block is softened, and the remaining oil during the punching process is removed.

After the first aged product is obtained, the present disclosure subjects the first aged product to surface treatment and second aging treatment to obtain the aluminum material.

In the present disclosure, the surface treatment is preferably granulating the surface of the aluminum alloy, the process of granulating the surface of the aluminum alloy preferably comprises the following steps: passing the first aging product through a tunnel with a dense spraying to obtain a dense annular gravure aluminum block with a uniform corrugated surface, the tunnel is sprayed with aluminum alloy particles with high surface strength, the particle size of the aluminum alloy particles is 0.3-1 mm. In the present disclosure, the aluminum alloy particles with high surface strength are preferably 3003 aluminum alloy particles with a hardness of 24-30 HB.

In the present disclosure, the dense annular gravure aluminum block is easy to be subjected to surface lubrication treatment, and the surface quality of the subsequent stretch forming is better.

In the present disclosure, the air pressure of the dense spray is preferably 2-10 bar, and the density of the dense spray is preferably 10-20 lattice/$mm^2$.

In the present disclosure, the temperature of the second aging treatment is preferably 80-200° C., and the time is preferably 0.5-2 h.

In the present disclosure, the second aging treatment can reduce the difference in the structure of the aluminum material.

After the second aging product is obtained, the present disclosure preferably mixes the obtained second aging product, polyol and fatty acid surface treatment agent, then performs surface additive treatment to obtain a transition layer, and then removes the transition layer to obtain the aluminum material. In the present disclosure, the transition layer can increase the surface lubrication effect of the aluminum material, and the surface lubrication effect during subsequent use can improve the efficiency of forming processing.

In the present disclosure, the polyol is preferably ethanol or ethylene glycol, and the fatty acid surface treatment agent is preferably sodium stearate, stearamide or N, N'-ethylene hisstearamide.

In the present disclosure, the mass ratio of the second aging product, polyol and fatty acid surface treatment agent is preferably 300-400:0.3-1.0:0.03-0.5.

In the present disclosure, the surface additive treatment is preferably carried out under the condition of surface rolling, the rotation speed of the surface rolling is preferably 10-80 rpm, and the time is preferably 10-30 min. The surface additive treatment can promote the appearance of a transition layer on the surface of the aluminum material, play the role of lubricating the surface of the aluminum material in later processing, and improve the efficiency of forming processing.

Figure 3:
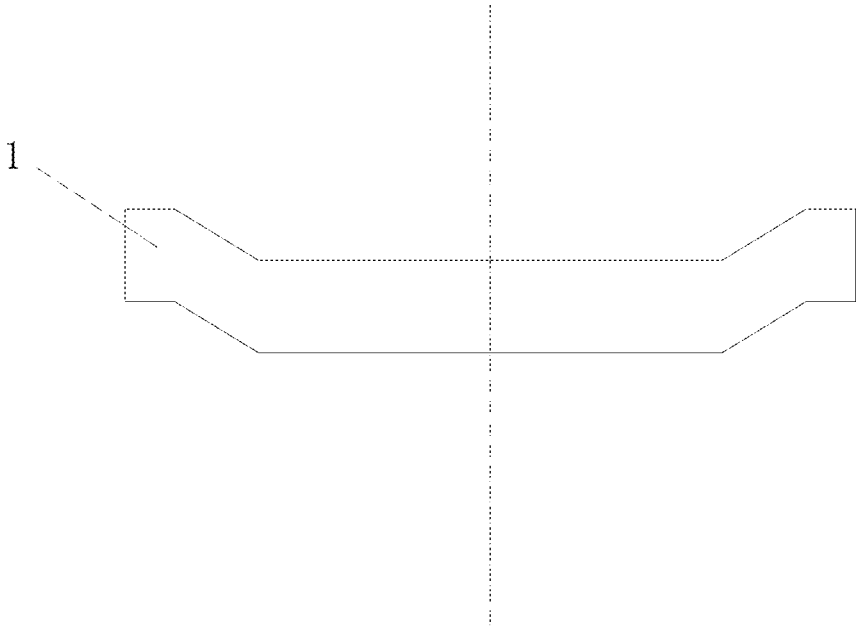
FIG. 3 is a side view of the bowl-shaped aluminum block.

The present disclosure also provides a bowl-shaped aluminum block, wherein the material is the aluminum material described in above technical schemes or the aluminum material prepared by the method described in above technical schemes. FIG. 3 is a side view of the bowl-shaped aluminum block, where 1 is a straight skirt, and the upper and lower surfaces are treated with granular protrusions with a diameter of 0.3-1 mm, which is conducive to surface lubrication treatment.

In the present disclosure, the outer diameter of the bowl-shaped aluminum block is preferably 34-80 mm, the depth is preferably 0.5-2 mm, the diameter of the inner concave surface is preferably 10-66 mm, and the angle of the inner concave surface to the horizontal plane is preferably 1-12°. In the present disclosure, the corners of the bowl-shaped aluminum block are right-angled, with relatively little sharp corner wear and less shattered aluminum, which can keep the mold clean for a long time. Moreover, it has an arched structure with good lubrication, which is conducive to the flow of aluminum during extrusion and stretching, and the appearance of the molded part is good.

The present disclosure does not have special restrictions on the preparation method of the bowl-shaped aluminum block, a preparation method well known to those skilled in the art can be used. Specifically, such as forming in the punching process, on the basis of ordinary punching, a special punching die is added to produce a concave bowl-shaped aluminum block with a non-planar structure.

In order to further illustrate the present disclosure, the aluminum material, the preparation method thereof, and the bowl-shaped aluminum block provided by the present disclosure will be described in detail below in conjunction with examples, but they should not be understood as limiting the protection scope of the present disclosure.

Example 1

The aluminum material of this example includes the following elements by mass percentage: 0.1% of Si, 0.25% of Fe, 0.01% of Cu, 0.3% of Mn, 0.03% of Mg, 0.02% of Zn, 0.02% of Ti, 0.03% of Ni, 0.01% of Sr, 0.01% of Zr, 0.01% of B and the balance of Al.

The preparation method is as follows:

Batching: A 1090 standard aluminum ingot and 10 wt % 3003 recycled aluminum material were mixed, evenly split and mixed, and hoisted into the blast furnace in units of 3T, then the materials were dispersed, the furnace was started to reach 600° C. for smelting, the molten state was maintained for 0.5 h, and then disturbed and stirred by a high-pressure gas column for 15 min to obtain the molten aluminum. The gas column was inert gas, after the Fe agent, Si agent, Cu agent, Mn agent, Mg agent, Zn agent, Ti agent, Ni agent, Zr agent and Sr agent were added to carry out a first slagging-off (stirring by air column), then sample analysis and secondary adjustment were carried out, and then the refined grains were added to the refining furnace, stirred by air column, and refined by adding special TI-B refining agent (including TI-B particles and rare earth refining agent, the amount of TI-B refining agent was 0.08 wt % of molten aluminum, wherein the amount of TI-B particles was 0.05 wt % and the amount of rare earth refining agent was 0.03 wt %). Then, the molten aluminum in the static furnace was introduced to the degassing device through the reverse flow pipe for online purification, degassing and slagging-off, and stress relief operations. After impurity removal and filtration using a secondary filter device, the aluminum liquid was roll-casted on the rotating belt casting machine by the continuously rotating casting rolls into aluminum coil blanks, then guided from the casting machine to the hot rolling mill, the thickness was reduced by 30% after the hot-rolling, and then guided into the cold rolling mill through the roll rail, and the thickness was reduced by 20% after cold-rolling. Finally, an aluminum plate with a width of 0.6 m was formed; the roll-casted aluminum plate was passed to the punching line, and punched into an aluminum block using a 100-ton punching machine (using MOBIL SHC CIBUS 68 lubricant with 5 g/50 work pieces per spray), the aluminum block was annealed in the annealing furnace (500° C.) for 2 h. During the annealing process, the top space of the annealing furnace was full of inert gas. After annealing, the aluminum block was kept at 400° C. for 2 h for the first aging treatment, then naturally cooled and stored for 2 h, and passed through a tunnel densely sprayed with aluminum alloy particles with extremely high surface strength (using 3003 aluminum alloy particles with a hardness of 24-30 HB, a particle size of 0.3-1 mm, an air pressure of the dense spray of 2 bar, and a density of the dense spray of 10 lattice/$mm^2$). The first aging product was subjected to the second aging treatment at 80° C. for 2 h, and then placed into the rotary surface treatment machine, polyol (ethanol) and fatty acid surface treatment agent (sodium stearate) were added thereto to perform the surface rolling treatment for 10 min, wherein the mass ratio of the second aging product, polyol and fatty acid surface treatment agent was 300:0.3:0.03. Finally, the finished aluminum block was vibrated with a fine stainless steel sieve to remove impurities, fixed and packed to obtain the aluminum material.

The aluminum material produced in this example was formed by the punching process. On the basis of ordinary punching, a special punching die was added to produce a concave bowl-shaped aluminum block with a non-planar structure. FIG. 3 is a side view of the bowl-shaped aluminum block, where 1 is a straight skirt, the upper and lower surfaces are treated with granular protrusions with a diameter of 0.3-1 mm, the outer diameter of the bowl-shaped aluminum block is 34 mm, and the depth is 0.5 mm. The diameter of the inner concave surface is 10 mm, and the angle between the inner concave surface and the horizontal plane is 1°.

The aluminum material obtained in this example has no oil stains, dust, pores, slag inclusions, no pull marks or tears on the surface, no sharp burrs or pits exceeding 0.2 mm, and no obvious grain direction.

Figure 2:
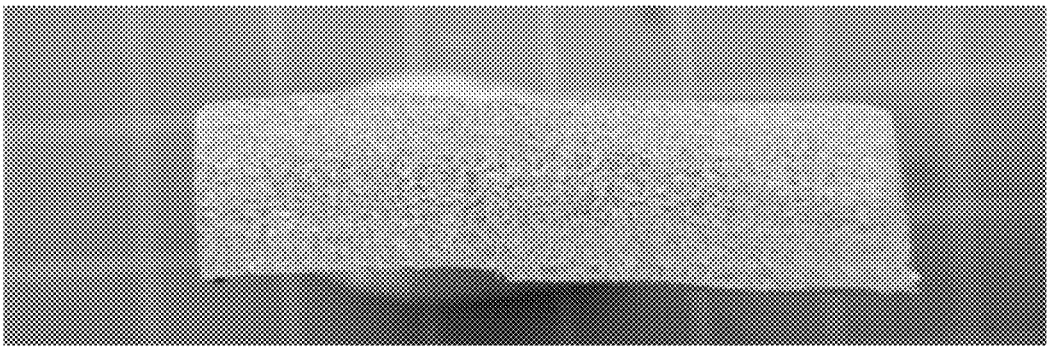
FIG. 2 is a physical photo of the aluminum material prepared in Example 1.

FIG. 1 is a microscopic morphology diagram of the aluminum material prepared in Example 1; FIG. 2 is a physical photo of the aluminum material prepared in Example 1. It can be seen from FIG. 1 and FIG. 2 that the internal structure of the aluminum material is uniform and the crystal grains are refined.

Example 2

The aluminum material of this example includes the following elements by mass percentage: 0.1% of Si, 0.35% of Fe, 0.05% of Cu, 0.03% of Mn, 0.03% of Mg, 0.05% of Zn, 0.05% of Ti, 0.03% of Ni, 0.05% of Sr, 0.05% of Zr, 0.05% of B and the balance of Al.

The preparation method is as follows:

Batching: A 1090 standard aluminum ingot and 10 wt % 3003 recycled aluminum material were mixed, evenly split and mixed, and hoisted into the blast furnace in units of 3T, then the materials were dispersed, the furnace was started to reach 600° C. for smelting, the molten state was maintained for 0.5 h, and then disturbed and stirred by a high-pressure gas column for 15 min to obtain the molten aluminum. The gas column was inert gas, after the Fe agent, Si agent, Cu agent, Mn agent, Mg agent, Zn agent, Ti agent, Ni agent, Zr agent and Sr agent were added to carry out a first slagging-off (stirring by air column), then sample analysis and secondary adjustment were carried out, and then the refined grains were added to the refining furnace, stirred by air column, and refined by adding special TI-B refining agent (including TI-B particles and rare earth refining agent, the amount of TI-B refining agent was 0.08 wt % of molten aluminum, wherein the amount of TI-B particles was 0.07 wt % and the amount of rare earth refining agent was 0.01 wt %). Then, the molten aluminum in the static furnace was introduced to the degassing device through the reverse flow pipe for online purification, degassing and slagging-off for 10 min, and stress relief operations. After impurity removal and filtration using a secondary filter device (filtering impurities above 60 mesh), the aluminum liquid was roll-casted on the rotating belt casting machine by the continuously rotating casting rolls into aluminum coil blanks, then guided from the casting machine to the hot rolling mill, the thickness was reduced by 30% after the hot-rolling, and then guided into the cold rolling mill through the roll rail, and the thickness was reduced by 20% after cold-rolling. Finally, an aluminum plate with a width of 0.6 m was formed; the roll-casted aluminum plate was passed to the punching line, and punched into an aluminum block using a 100-ton punching machine (using MOBIL SHC CIBUS 68 lubricant with 10 g/50 work pieces per spray), the aluminum block was annealed in the annealing furnace (300° C.) for 20 h. During the annealing process, the top space of the annealing furnace was full of inert gas. After annealing, the aluminum block was kept at 300° C. for 20 h for the first aging treatment, then naturally cooled and stored for 2 h, and passed through a tunnel densely sprayed with aluminum alloy particles with extremely high surface strength (using 3003 aluminum alloy particles with a hardness of 24-30 HB, a particle size of 0.3-1 mm, an air pressure of the dense spray of 2 bar, and a density of the dense spray of 10 lattice/$mm^2$). The first aging product was subjected to the second aging treatment at 200° C. for 0.5 h, and then placed into the rotary surface treatment machine, polyol (ethanol) and fatty acid surface treatment agent (sodium stearate) were added thereto to perform the surface rolling treatment for 10 min, wherein the mass ratio of the second aging product, polyol and fatty acid surface treatment agent was 400:1.0:0.05. Finally, the finished aluminum block was vibrated with a fine stainless steel sieve to remove impurities, fixed and packed to obtain the aluminum material.

The aluminum material obtained in this example has no oil stains, dust, pores, slag inclusions, no pull marks or tears on the surface, no sharp burrs or pits exceeding 0.2 mm, and no obvious grain direction.

Comparative Example Commercially available 1070A aluminum material 1070A aluminum material includes the following elements in mass percentage: 0.2% of Si, 0.25% of Fe, 0.03% of Cu, 0.03% of Mn, 0.03% of Mg, 0.07% of Zn, 0.03% of Ti and the balance of Al.

The performance of the aluminum materials of Examples 1-2 and Comparative Examples were measured, and the results are shown in Table 1.

TABLE 1

Performance of the aluminum materials of Examples 1-2 and Comparative Examples

| | technical indicator | | | | |
|---|---|---|---|---|---|
| material | hardness (HB2.5/15.625) | maximum strength Rm (MPa) | yield strength Rp0.2 (MPa) | elongation at break % | granularity per unit area pcs/$mm^2$ |
| Example 1 | 24 | 85 | 40 | 45 | 15 |
| Example 2 | 30 | 100 | 59 | 50 | 40 |
| Comparative Example | 18.5 | 70 | 34 | 42 | — |

The aluminum material of Example 1 was used to make a D59 aluminum can product with a wall thickness of 0.3 mm, and the wall thickness of the D59 aluminum can product produced from the 1070A aluminum material needs to be 0.34 mm.

Using the same weight of aluminum material, the strength of the aluminum can made of the aluminum material of Example 1 is 15% higher than that of the aluminum can made using the 1070 aluminum material of Comparative Example. The results are shown in Table 2.

TABLE 2

Performance of aluminum cans made from aluminum materials of Example 1 and Comparative Example

| | aluminum material of Example 1 | 1070 aluminum material of Comparative Example |
|---|---|---|
| aluminum specifications | 6.3 mm | 6.3 mm |
| height of finished product | 194 mm | D 59 × 194 mm |
| compressive strength of finished product KN | 4.6 | 4.0 |
| internal pressure resistance of empty can MPa | 1.1 | 0.9 |

The description of the above embodiments is only used to help understand the method and core idea of the present disclosure. It should be pointed out that for those of ordinary skill in the art, without departing from the principle of the present disclosure, several improvements and modifications can be made to the present disclosure, and these improvements and modifications also fall within the protection scope of the claims of the present disclosure. Various modifications to these embodiments are obvious to those skilled in the art, and the general principles defined herein can be implemented in other embodiments without departing from the spirit or scope of the present disclosure. Therefore, the present disclosure will not be limited to the embodiments shown in this document, but should conform to the widest scope consistent with the principles and novel features disclosed in this document.

What is claimed is:

1. An aluminum material, wherein comprising the following elements by mass percentage: 0.1-0.2% of Si, 0.25-0.35% of Fe, 0-0.05% of Cu, 0.03-0.5% of Mn, 0-0.03% of Mg, 0-0.05% of Zn, 0-0.05% of Ti, 0-0.03% of Ni, 0.01-0.03% of Sr, 0-0.05% of Zr, 0-0.05% of B, balance of Al, wherein a mass percentage of Al is more than or equal to 99.2%, and the mass percentages of Cu, Mg, Zn, Ti, Ni, Zr and B are not zero.

2. The aluminum material according to claim 1, wherein the aluminum material comprises 0.15-0.18 wt % of Si.

3. The aluminum material according to claim 1, wherein the aluminum material comprises 0.28-0.32 wt % of Fe.

4. The aluminum material according to claim 1, wherein the aluminum material comprises 0.01-0.03 wt % of Cu.

5. The aluminum material according to claim 1, wherein the aluminum material comprises 0.1-0.3 wt % of Mn.

6. The aluminum material according to claim 1, wherein the aluminum material comprises 0.01-0.02 wt % of Mg.

7. The aluminum material according to claim 1, wherein the aluminum material comprises 0.01-0.03 wt % of Zn.

8. The aluminum material according to claim 1, wherein the aluminum material comprises 0.01-0.03 wt % of Ti.

9. The aluminum material according to claim 1, wherein the aluminum material comprises 0.01-0.02 wt % of Ni.

10. The aluminum material according to claim 1, wherein the aluminum material comprises 0.01-0.03 wt % of Zr.

11. The aluminum material according to claim 1, wherein the aluminum material comprises the following elements by mass percentage: 0.1% of Si, 0.25% of Fe, 0.01% of Cu, 0.3% of Mn, 0.03% of Mg, 0.02% of Zn, 0.02% of Ti, 0.03% of Ni, 0.01% of Sr, 0.01% of Zr, 0.01% of B and balance of Al.

12. The aluminum material according to claim 1, wherein the aluminum material comprises the following elements by mass percentage: 0.1% of Si, 0.35% of Fe, 0.05% of Cu, 0.03% of Mn, 0.03% of Mg, 0.05% of Zn, 0.05% of Ti, 0.03% of Ni, 0.05% of Sr, 0.05% of Zr, 0.05% of B and balance of Al.

13. The aluminum material according to claim 1, wherein the aluminum material has a hardness of 23-30 HB, a tensile strength of 70-100 MPa, a yield strength of 35-59 MPa, and an elongation at break of 40-60%.

14. A bowl-shaped aluminum block having aluminum material comprising the following elements by mass percentage: 0.1-0.2% of Si, 0.25-0.35% of Fe, 0-0.05% of Cu, 0.03-0.5% of Mn, 0-0.03% of Mg, 0-0.05% of Zn, 0-0.05% of Ti, 0-0.03% of Ni, 0.01-0.03% of Sr, 0-0.05% of Zr, 0-0.05% of B, balance of Al, wherein a mass percentage of Al is more than or equal to 99.2%, and the mass percentages of Cu, Mg, Zn, Ti, Ni, Zr and B are not zero.

15. The bowl-shaped aluminum block according to claim 14, wherein an outer diameter of the bowl-shaped aluminum block is 34-80 mm, a depth is 0.5-2 mm, a diameter of an inner concave surface is 10-66 mm, and an angle of the inner concave surface to a horizontal plane is 1-12°.

* * * * *